US007604036B2

(12) United States Patent
Thompson et al.

(10) Patent No.: US 7,604,036 B2
(45) Date of Patent: Oct. 20, 2009

(54) SYSTEM FOR CONNECTING AWNING CANOPY TO SUPPORT SURFACE

(75) Inventors: Scott P. Thompson, Boulder, CO (US); Robert Wagner, Longmont, CO (US)

(73) Assignee: Carefree/Scott Fetzer Company, Broomfield, CO (US)

( * ) Notice: Subject to any disclaimer, the term of this patent is extended or adjusted under 35 U.S.C. 154(b) by 407 days.

(21) Appl. No.: 11/284,327

(22) Filed: Nov. 21, 2005

(65) Prior Publication Data

US 2007/0113988 A1 May 24, 2007

(51) Int. Cl.
*E04F 10/00* (2006.01)
*E04F 10/06* (2006.01)

(52) U.S. Cl. ..... 160/22; 160/67

(58) Field of Classification Search ..... 160/133, 160/22, 25, 45, 47, 61, 66, 67, 68, 78; 296/163, 296/100.01; 49/71; 52/74; 135/88.11, 88.12
See application file for complete search history.

(56) References Cited

U.S. PATENT DOCUMENTS

| | | | | |
|---|---|---|---|---|
| 4,634,172 | A * | 1/1987 | Duda | 296/163 |
| 4,909,296 | A | 3/1990 | Sellke et al. | |
| 4,924,895 | A * | 5/1990 | Bailie | 160/67 |
| 4,941,524 | A * | 7/1990 | Greer | 160/67 |
| 5,433,259 | A | 7/1995 | Faludy | |
| 5,437,322 | A * | 8/1995 | Murray | 160/61 |
| 6,279,641 | B1 * | 8/2001 | Malott | 160/67 |
| 6,619,726 | B2 * | 9/2003 | Jones | 296/163 |

* cited by examiner

*Primary Examiner*—Katherine W Mitchell
*Assistant Examiner*—Jeremy C Ramsey
(74) *Attorney, Agent, or Firm*—Dorsey & Whitney LLP

(57) ABSTRACT

A connection system for a retractable awning for connecting the canopy of the awning to a support surface includes a rigid or semi-rigid cover and may or may not include a flexible strip of material secured thereto such that when the awning is fully retracted, the rigid or semi-rigid cover extends around a substantial portion of the awning canopy wrapped on a roll bar for the awning to protect the canopy from environmental elements.

15 Claims, 16 Drawing Sheets

SYSTEM FOR CONNECTING AWNING CANOPY TO SUPPORT SURFACE

BACKGROUND OF THE INVENTION

1. Field of the Invention

A system for connecting the inner edge of a retractable awning canopy to a support surface wherein the awning has a flexible canopy having its outer edge secured to a rotatable roll bar and a support system mounted on the support surface for moving the roll bar between extended and retracted positions.

2. Description of the Relevant Art

Retractable awnings have been used for numerous years primarily as retractable coverings for doorways, windows and the like. In more recent years, retractable awnings have been mounted on the sides of recreational vehicles, mobile homes or the like. It is apparent in such uses the support surface for the awning is movable with the vehicle and therefore different systems have been employed for mounting and protecting the awning both when it is stationary and when in transit with the vehicle.

Retractable awnings typically include an awning canopy having a retractable roll bar along its outer edge around which the canopy can be wrapped when it is moved from its extended to a retracted position adjacent a support surface. Various support systems have been devised for moving the roll bar between extended and retracted positions and further systems have been employed for connecting the inner edge of the awning canopy to the support surface in a manner to protect the awning canopy in the retracted position.

As will be appreciated, if the inner edge of the awning canopy itself were connected to the support surface when the awning was fully retracted, an inner edge portion of the awning canopy would be exposed around the perimeter of the roll bar to environmental elements such as sun, wind, rain, and the like. Accordingly, systems have been employed to cover and thereby protect the canopy fabric when in the retracted position of the awning. One such system is a plurality of longitudinally extending interconnected articulated slats that are either connected to the innermost edge of the canopy or secured over the canopy along an inner portion thereof so that during the last roll of the roll bar the articulated slats form an arcuate covering around the wrapped canopy fabric. Further, weather-resistant flexible strips have been used in lieu of the articulated slats which also help to protect the canopy fabric.

Such covers have not been entirely satisfactory, however, inasmuch as water may leak, for example, between articulated slats when the awning is retracted or weather-resistant fabric strips may tear. Accordingly, alternative systems for protecting the awning canopy in the retracted position of the awning are desirous.

It is to overcome the shortcomings in the prior art and to provide a new and improved system for connecting an awning canopy to a support surface in a manner to protect the awning canopy in its retracted position that the present invention has been developed.

BRIEF SUMMARY OF THE INVENTION

The present invention is an improved system for interconnecting a retractable awning canopy to a support surface wherein the awning has a flexible canopy with a roll bar along its outer or distal edge around which the canopy can be wrapped when the awning is retracted. A support system mounted on the support surface and connected to the roll bar is also provided for reversibly moving the awning between extended and retracted positions.

In accordance with the present invention, the inner or proximal edge of the awning canopy is connected to a connection system that includes a generally semicylindrically-shaped rigid cover connected to a flexible strip of material along its innermost edge and wherein the flexible strip of material has its inner or proximal edge secured to the support surface. The connection system thereby provides a flexible means by which the awning canopy is connected to the support surface and such that when the awning is retracted, the awning roller with the canopy wrapped therearound is tucked into the rigid cover of the connection system just before the awning becomes fully retracted so that the cover provides a protective outer layer around the retracted awning canopy. The awning canopy is thereby protected from environmental elements in its retracted position. In one embodiment, the cover for the connection system is in actuality slightly greater than semicylindrical so that it snaps around the canopy covered roll bar to retain a positive relationship therewith.

At least one gutter may also be incorporated into the cover along its innermost edge and adjacent to the connection of the cover to the flexible strip to capture moisture that might overlie the connection system.

Other aspects, features and details of the present invention can be more completely understood by reference to the following detailed description of a preferred embodiment, taken in conjunction with the drawings and from the appended claims.

DETAILED DESCRIPTION OF THE INVENTION

Retractable awnings have been structured in numerous ways. Typically they include an awning canopy secured along an inner edge to a support structure and along an outer edge to a roll bar about which the canopy can be wrapped when in a retracted position. Of course, in an extended position, the canopy is unwrapped from the roll bar. The roll bar is supported with a support system typically mounted on the support structure with the support system being extendable and retractable to move the awning between extended and retracted positions. Numerous types of support systems have been devised with some including rafters and separate support arms while others simply have extendable arms that interconnect the support surface with the roll bar. While the present invention will be described in connection with a particular retractable awning, it is to be understood that but for the connection system of the present invention, the awning could assume numerous forms with it only being important that the awning include the flexible canopy sheet, a roll bar about which the canopy can be wrapped, and a support system for moving the awning between extended and retracted positions. In some retractable awnings, the roll bar is disposed along the inner edge of the awning canopy and a simple lead bar extends along the outer edge but for purposes of the present disclosure, the roll bar is disclosed as being anchored to the outer edge of the awning canopy with the inner edge being secured to the support surface through the flexible connection system of the present invention.

Figure 1:
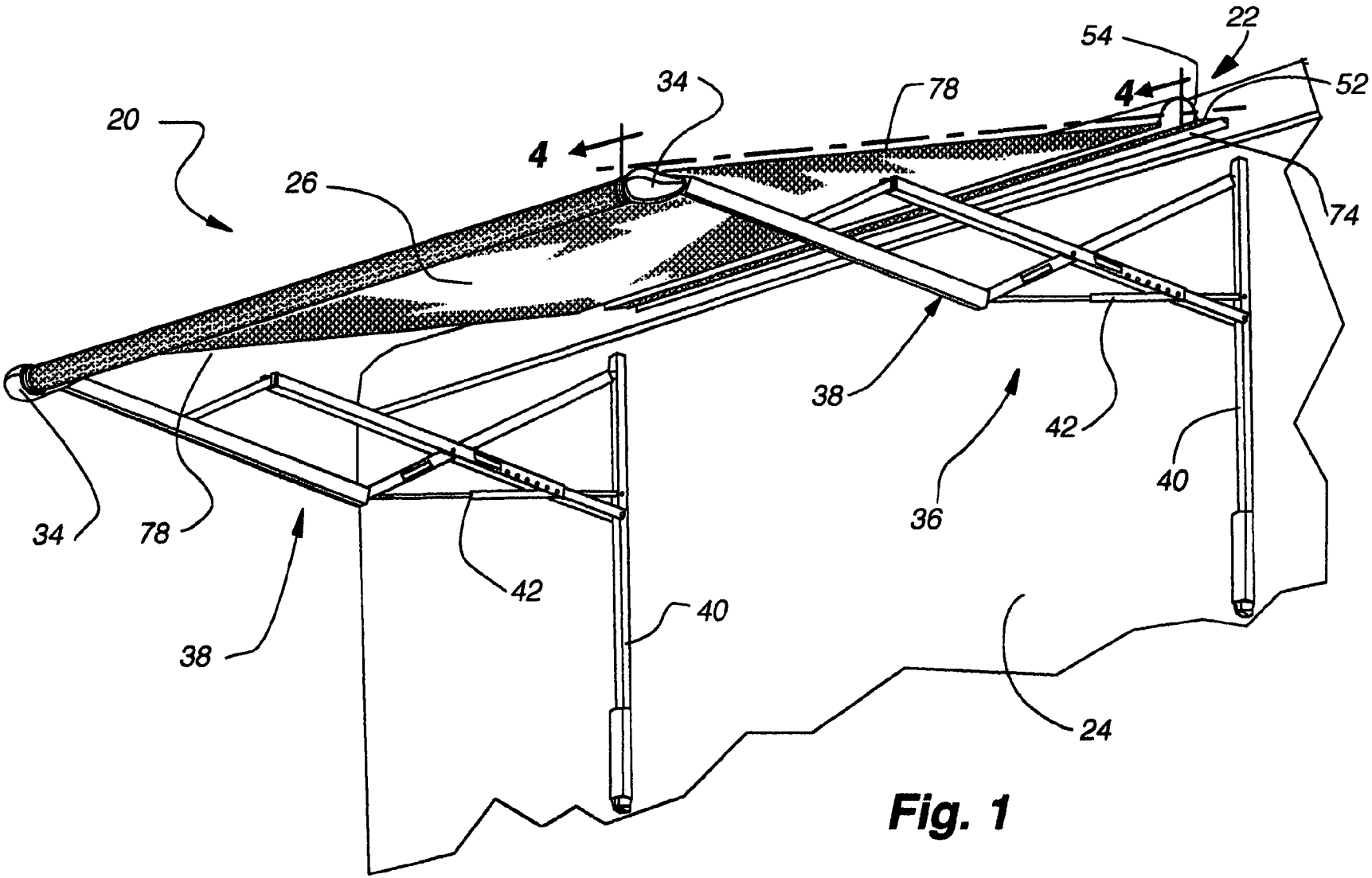
FIG. 1 is a fragmentary isometric of a retractable awning in an extended position wherein the awning includes the connection system of the present invention.
Figure 2:
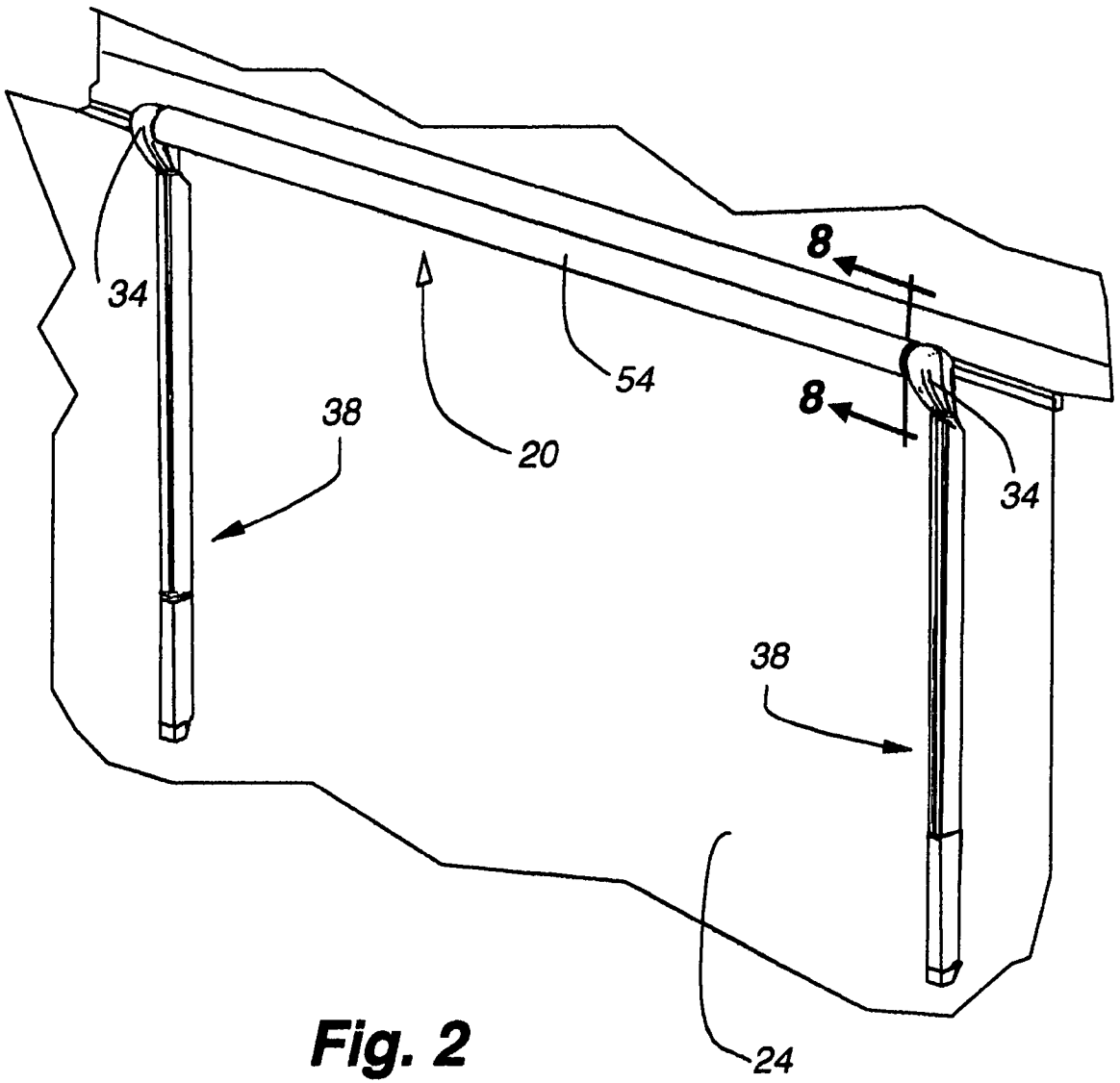
FIG. 2 is a fragmentary isometric similar to FIG. 1 with the awning in a retracted position.

Looking first at FIG. 1, an awning 20 incorporating the connection system 22 of the present invention is shown mounted on a vertical support surface 24 which might be for example the side wall of a recreational vehicle, mobile home, or more permanent building structure. The awning includes a flexible awning canopy 26 having an inner or proximal edge 28 secured to the flexible connection system 22 in a manner to be described in more detail hereafter and an outer edge 30 secured to a roll bar 32 which is motor driven by one or two motors 34 that are operatively connected to and supported by a support system 36 in the form of a pair of scissors-type arms 38. The support system disclosed is of the type shown in more detail in U.S. patent application Ser. No. 10/645,264, which is of common ownership with the present application and the disclosure of which is hereby incorporated by reference. Suffice it to say the support system includes the scissors-type arms 38 mounted on a vertical track 40 on the support surface 24. The support system is shown extended in FIG. 1 with the awning in the extended position and fully retracted in FIG. 2 wherein it will be appreciated the support system is vertically disposed and in close adjacent relationship with the support surface.

Figure 3:
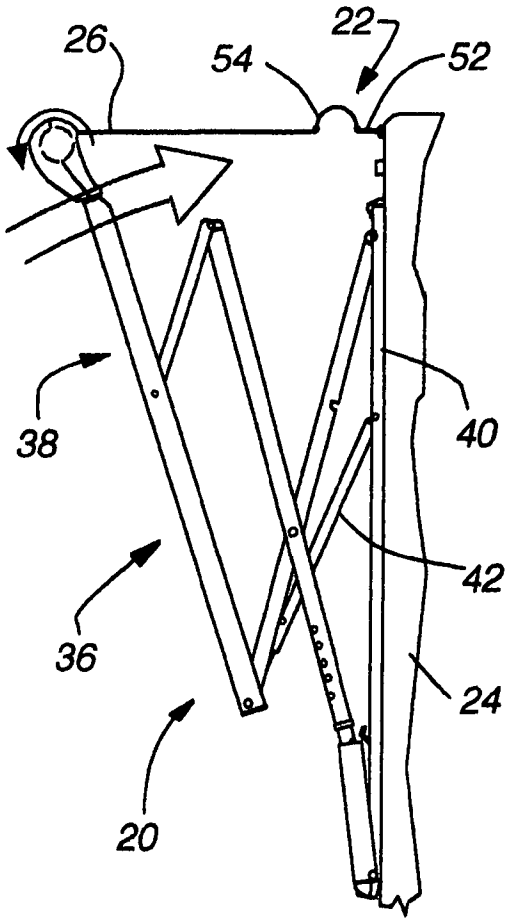
FIG. 3 is a fragmentary side elevation of the awning of FIG. 1 in a partially retracted position.

As will be appreciated, and as possibly best illustrated in FIG. 3, as the motors 34 are driven in one or the other direction, the awning canopy 26 is rolled onto or unrolled from the roll bar 32 causing the awning to retract or extend respectively in cooperation with gas springs 42 associated with each support arm 38. Of course, when the roll bar is rotated as shown in FIG. 3 in a direction to retract the awning by wrapping the awning canopy about the roll bar, the support arms are forced to retract against the bias of the gas springs until in the fully retracted position of FIG. 2.

Figure 8:
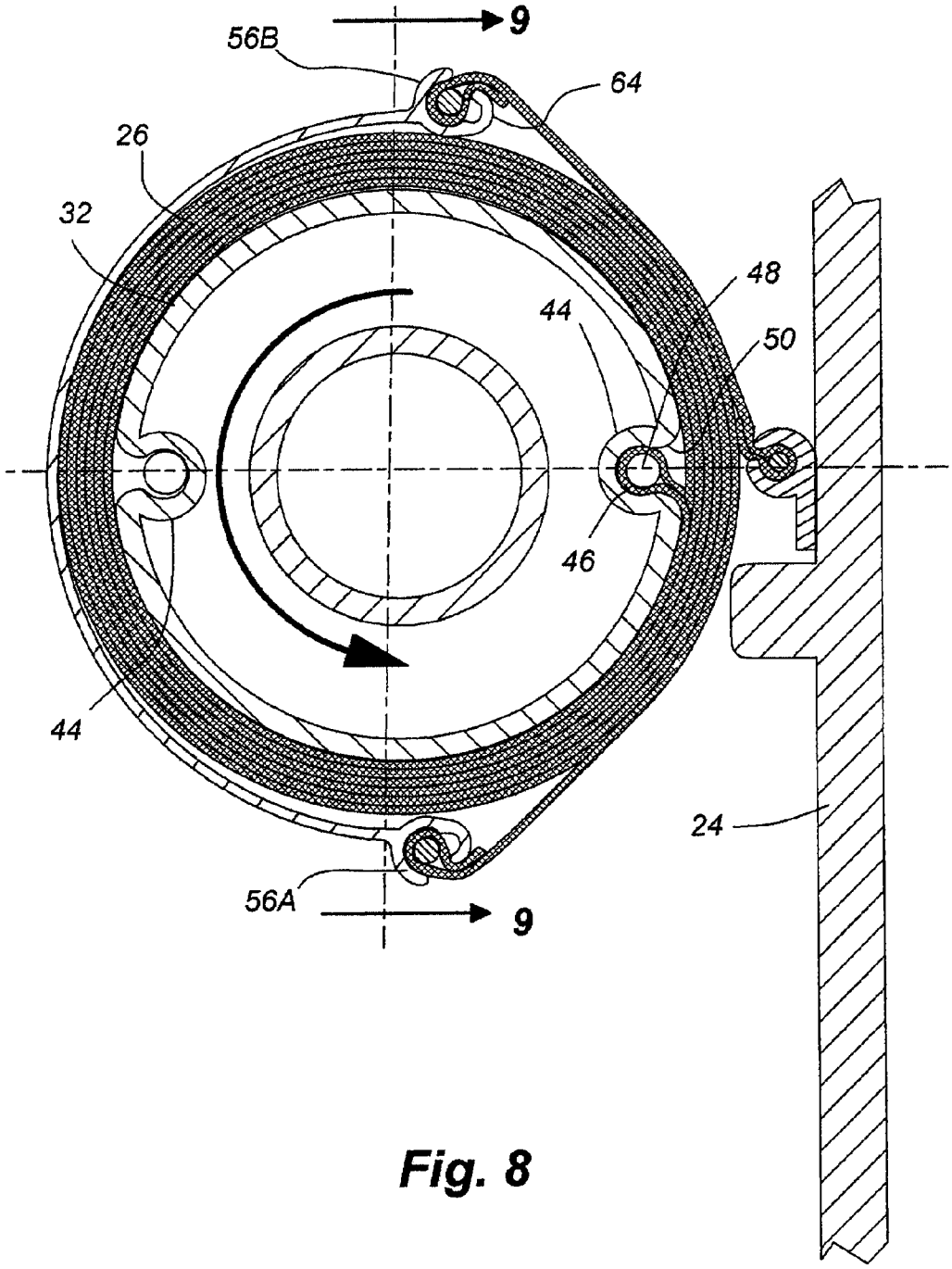
FIG. 8 is an enlarged section similar to FIG. 7 with the awning fully retracted.

As possibly best seen in FIG. 8, the canopy 26 is secured to the roll bar 32 in a conventional manner wherein the roll bar has a pair of diametrically opposed C-shaped grooves 44 which open through the outer circumferential surface of the roll bar so that a hem 46 along the outer or distal edge 30 of the awning canopy can be inserted into one of the C-shaped grooves and retained therein with a retention rod 48 inserted through the hem. The rod is of a larger diameter than the slot 50 defined in the outer circumference of the roll bar by the C-shaped groove to secure the canopy outer edge to the roll bar.

Figure 4:
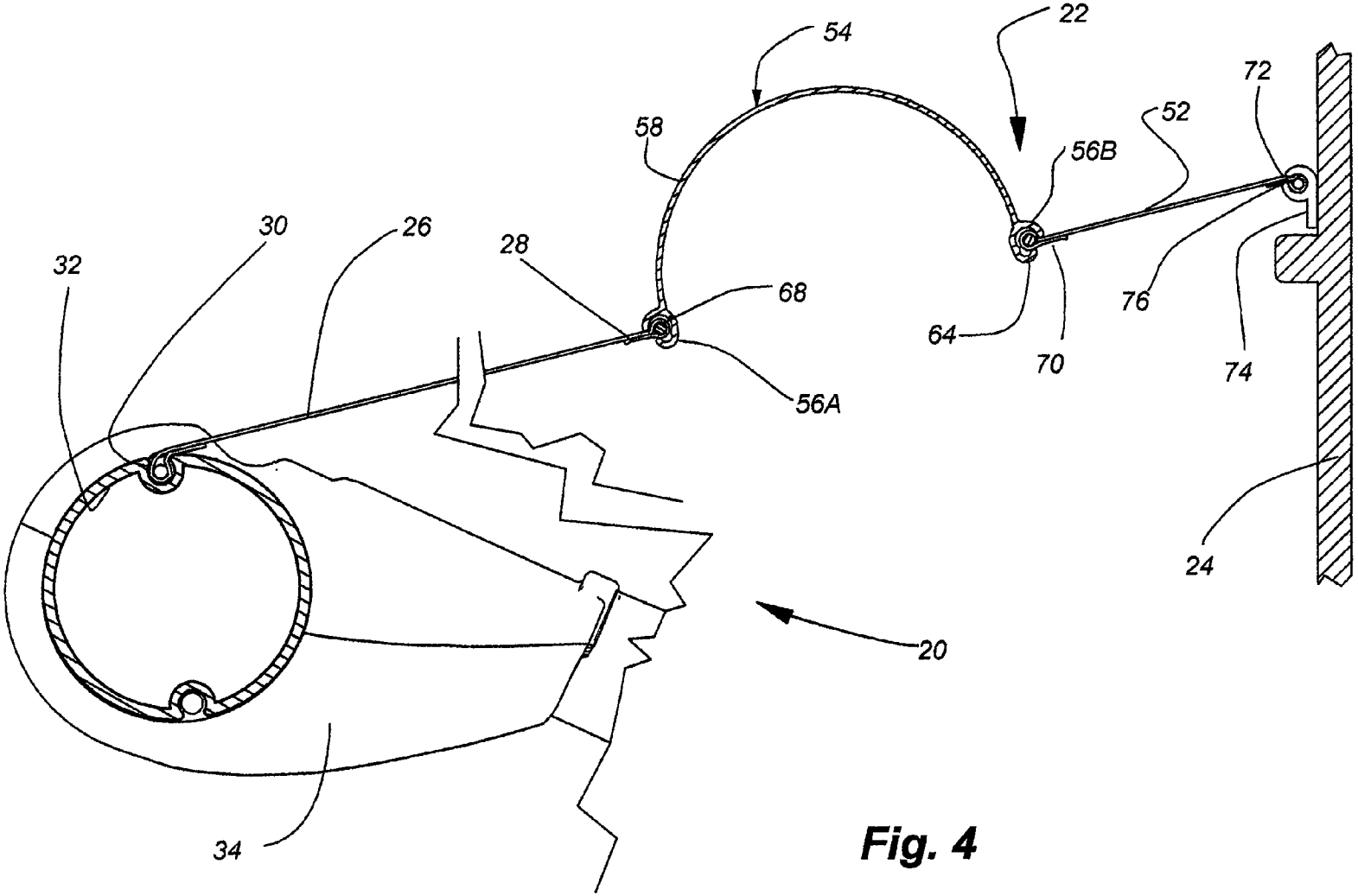
FIG. 4 is an enlarged fragmentary section taken along line 4-4 of FIG. 1.
Figure 11:
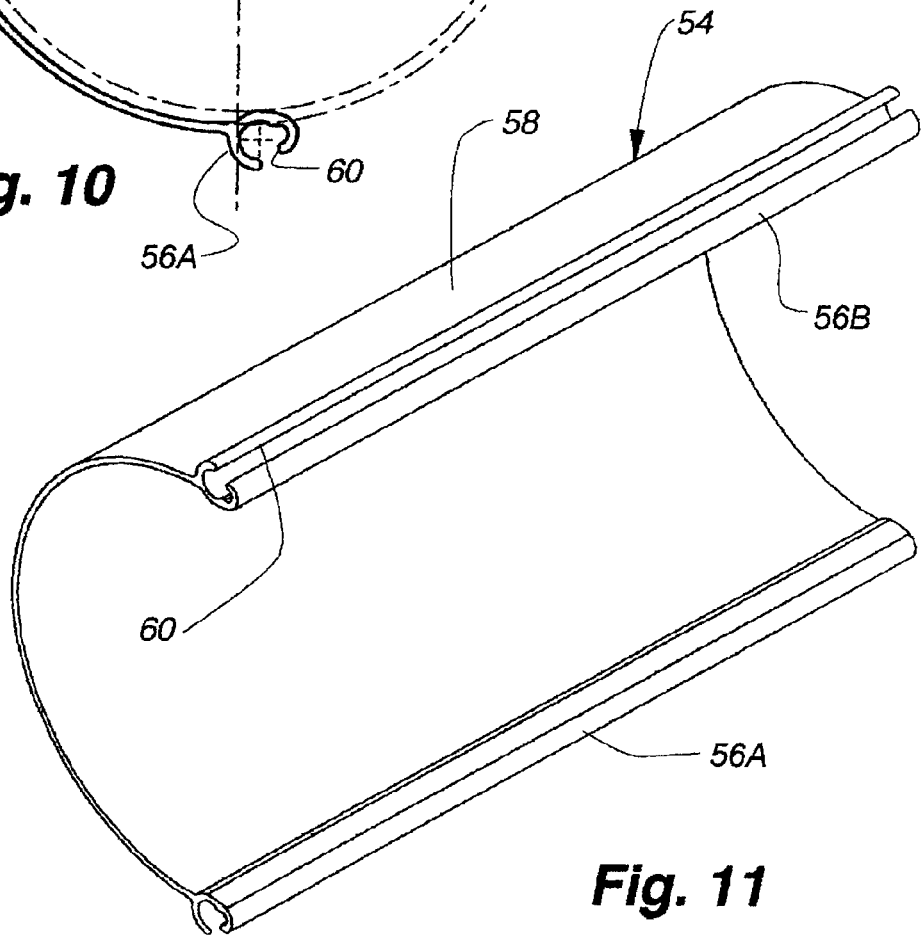
FIG. 11 is an isometric of the semicylindrical cover of FIG. 10.

With reference to FIG. 4, the flexible connection system 22 of the present invention can be seen to include a flexible strip of material 52 interconnected with a rigid or semi-rigid cover 54 that is generally semicylindrical in configuration but in reality has a main body with an arcuate curvature slightly greater than 180. degree. The cover could be made of any suitable weather resistant rigid or semi-rigid material such as aluminum, plastic, or the like which will substantially retain the semicylindrical configuration. The generally semicylindrical cover 54 has longitudinally extending hollow beads 56A and 56B of generally C-shaped or oval configuration along opposite longitudinal edges of a main body 58 of the cover with the bead 56*a* along the outer edge of the cover having a slot 60 (FIG. 11) opening outwardly of the cover away from the support surface and the bead 56B along the inner edge of the cover having a slot 61 opening outwardly of the cover and toward the support surface. A trough or gutter 64 of generally J-shaped cross section forms an integral circumferential extension from the inner edge of the generally semicylindrical cover immediately beneath the bead 56B for a purpose to be described hereafter.

The bead 56A along the outer edge of the cover main body 58 is interconnected with the inner or proximal edge 28 of the awning canopy 26, which is also hemmed and retained in the bead with an elongated retention rod 68 inserted through the hem.

The strip of flexible material 52 forming part of the connection system 22 can be any suitable material having some flexibility and preferably being resistive to detrimental environmental elements such as rain, UV radiation, wind, and the like. Textile materials exhibiting these characteristics or that have been treated to exhibit such characteristics might be suitable as well as flexible metallic materials and the like. The strip of material 52 is elongated having hems along opposite longitudinal edges with the outer or distal edge 70 being secured in the inner beaded edge 56B of the rigid cover main body in the manner previously described. The inner or proximal edge 72 of the flexible strip is hemmed and secured to a mounting rail 74 that has a C-shaped groove 76 formed therein so that the inner edge can be secured to the mounting rail in the manner previously described. The mounting rail, of course, is secured to the support surface in any suitable manner.

Figure 5:
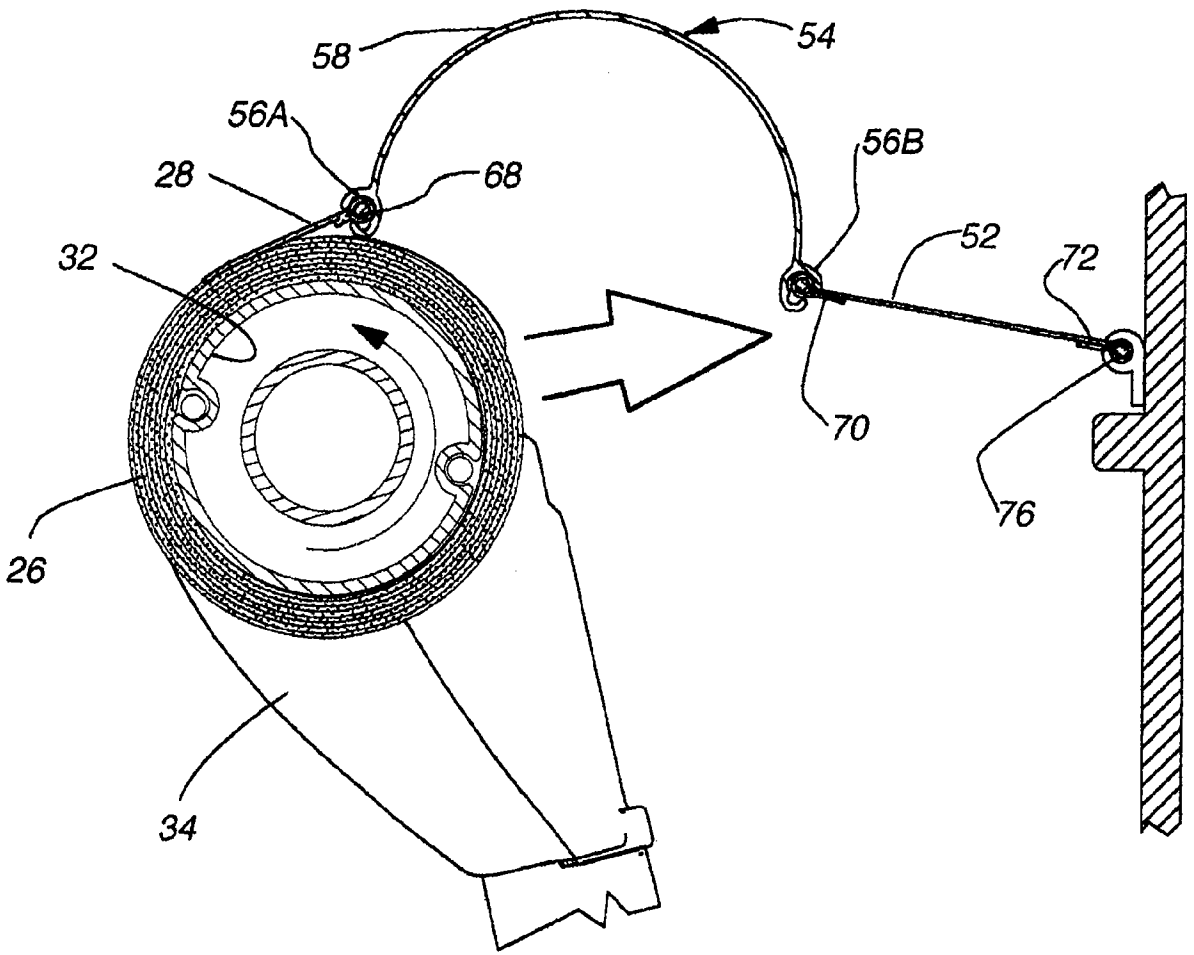
FIG. 5 is a section similar to FIG. 4 showing the awning being retracted and immediately before the roll bar becomes tucked into the semicylindrical cover.
Figure 7:
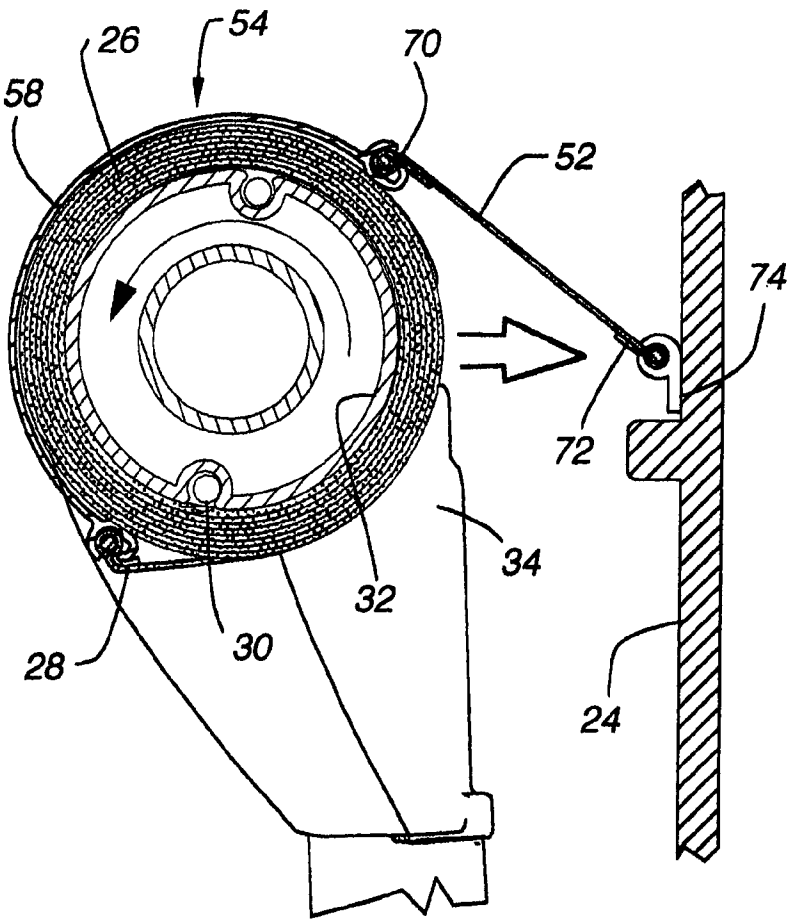
FIG. 7 is a fragmentary section similar to FIG. 6 with the roll bar fully tucked within the semicylindrical cover.
Figure 6:
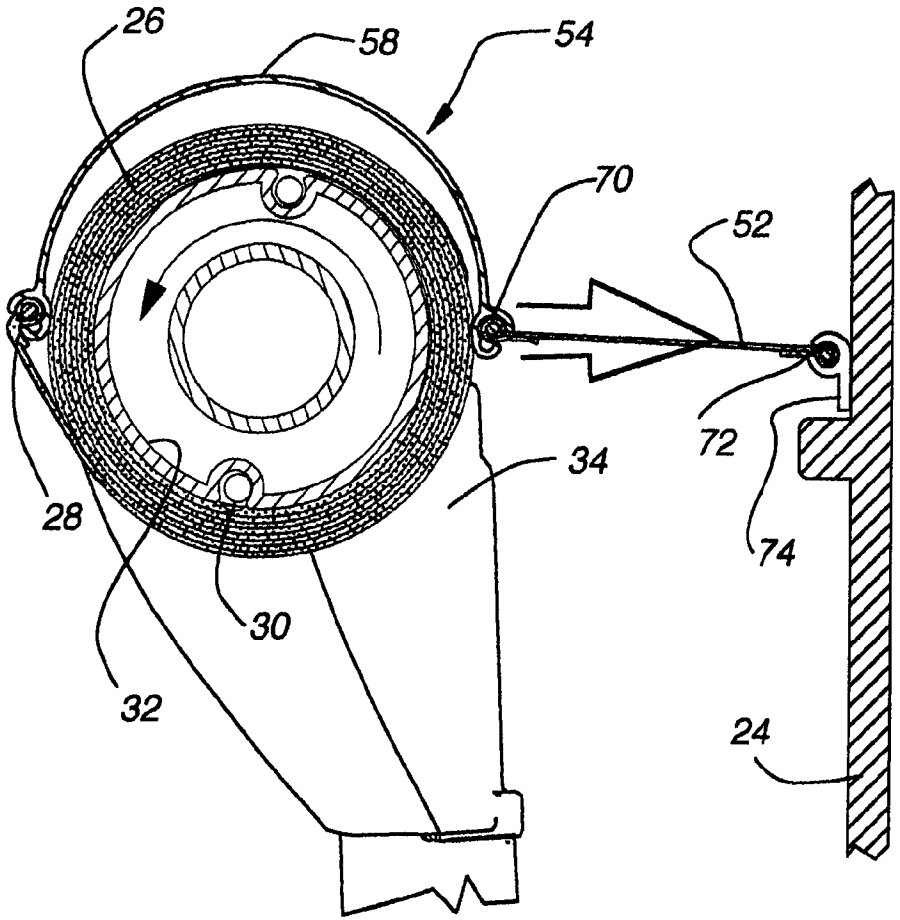
FIG. 6 is a section similar to FIG. 5 with the roll bar substantially tucked into the semicylindrical cover.

When the awning 20 is extended as shown in FIGS. 1 and 4, the connection system 22 merely forms an extension of predetermined width from the support surface 24 to the inner or proximal edge 28 of the awning canopy but as the awning is retracted as shown in FIG. 3 with the roll bar rotating counter-clockwise, the canopy 26 becomes wrapped around the roll bar 32 with the roll bar approaching the connection system. With reference to FIG. 5, as the roll bar reaches the outer beaded edge 56A of the cover, and the roll bar continues to rotate in a counterclockwise direction, it begins to pass beneath the outer edge of the cover and on further movement as seen in FIG. 6, the roll bar actually tucks itself into the hollow interior of the cover until it is fully tucked in the cover with the cover forming a rigid or semi-rigid covering around approximately half of the awning canopy wrapped roll bar. Continued rotation of the roll bar causes the cover to pivot about its inner edge 56B which is connected to the distal edge 70 of the flexible strip 52 until the awning reaches the position shown in FIG. 8 with the cover extending around the outer horizontal half of the wrapped canopy material and the flexible strip covering the top of the inner horizontal half of the wrapped canopy material. In the position of FIG. 8, the awning is fully retracted and as will be appreciated is covered on all exposed sides except the bottom of the inner horizontal half which is naturally not exposed to rain, UV radiation, or the like and therefore needs no covering. Of course, the motors 34 can be provided with override switches to stop rotation of the roll bar when the awning reaches the fully retracted position of FIG. 8 or other similar systems well known in the art could be employed for this purpose.

As is probably best appreciated by reference to FIG. 4, when the awning is extended, the flexible strip 52 as well as the awning canopy are sloped downwardly away from the support surface. Water, which is received on the awning as during a rain storm, will therefore run across the flexible strip and the canopy away from the support surface. Water running down the flexible strip 52 will encounter the beaded edge 56B of the cover and will tend to pool as it eventually runs off one side or the other of the awning. As the water pools, it can seep through the hem along the outer or distal edge of the flexible strip or even seep through the bead 56B. To catch or trap any such seepage, the trough or gutter 64 is positioned immediately beneath the bead. Water caught in the trough will flow to one side or the other of the awning to keep the area beneath the awning dry.

Figure 9:
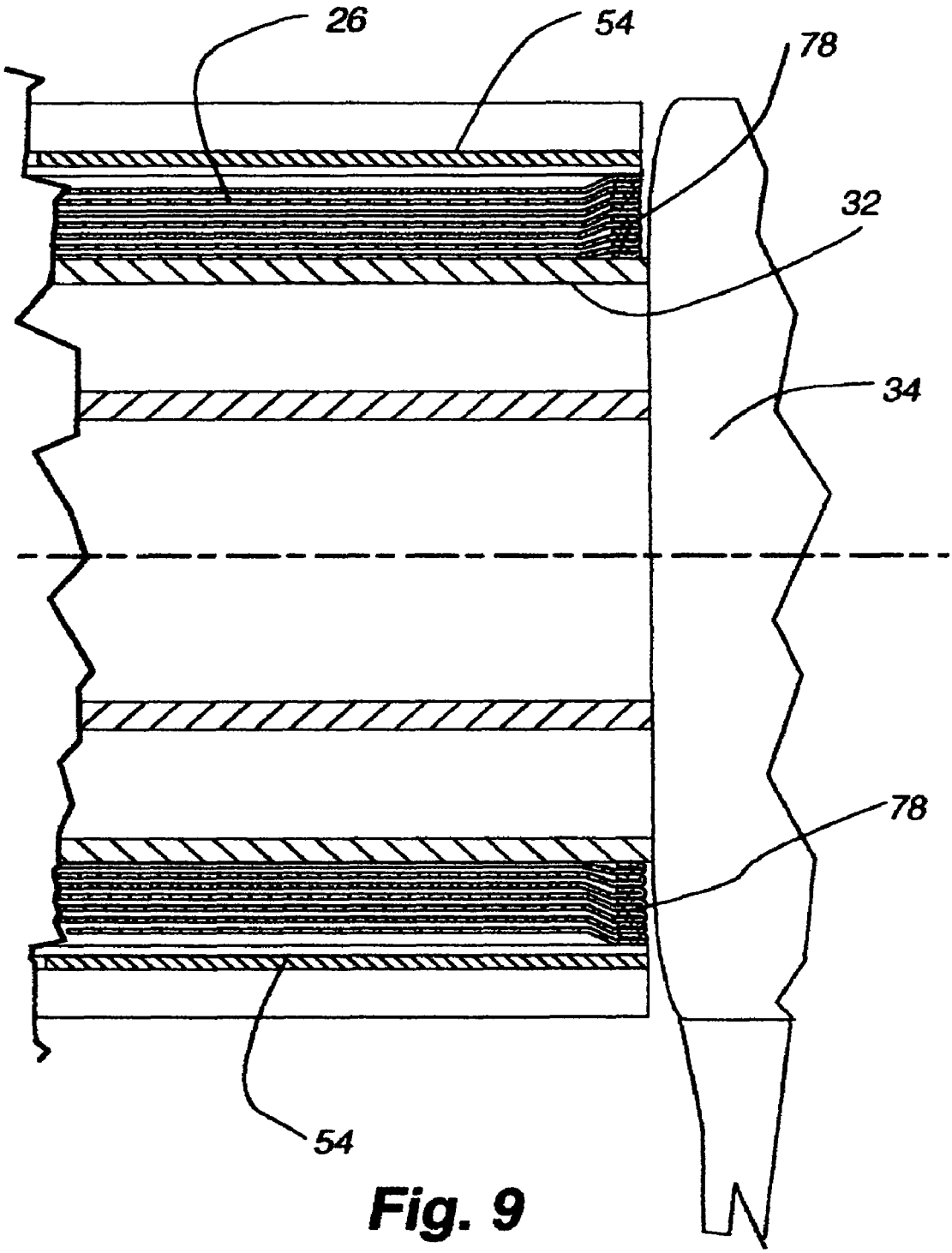
FIG. 9 is a fragmentary section taken along line 9-9 of FIG. 8.
Figure 10:
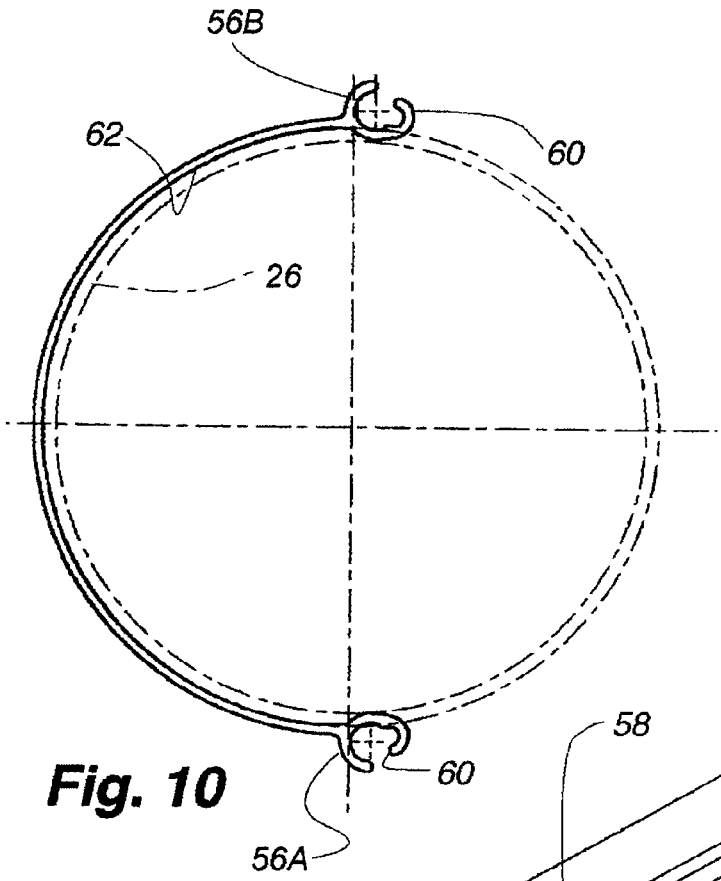
FIG. 10 is an end elevation of the semicylindrical cover in position on the canopy covered roll bar which is shown in phantom lines.

An important feature of the invention is illustrated in FIG. 9 wherein it will be appreciated the side edges 78 of the awning canopy 26 have also been hemmed so as to be of slightly thicker dimension than the canopy material extending therebetween. The hemmed side edges are accumulated on the roll bar 32 in circular stacks at opposite ends of the roll bar and therefore have a greater height or thickness than the canopy material therebetween. When the awning is fully retracted, the awning cover 54 engages the stacked hemmed side edges of the canopy material but not the material therebetween so as to avoid damage or wrinkling of the canopy material therebetween.

As can be appreciated by reference to FIG. 8 as mentioned previously, the trough 64 forms a circumferential extension of the cover from the bead 56B. Further, the trough 64 and the bead 56A are more than 180. degree. displaced from each other along the cover so they will actually grip the canopy fabric 26 along the hemmed side edges 78 thereof in an over-center relationship to hold the cover tightly on the roll bar in the retracted position of the awning.

Figure 12A:
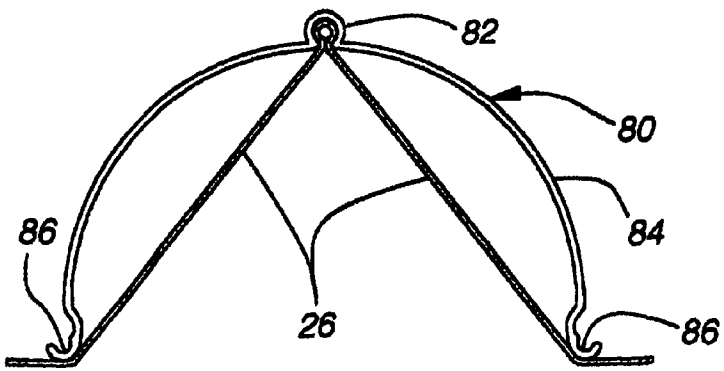
FIG. 12*a* is an end elevation of a second alternative embodiment utilizing a semicylindrical cover for connecting an awning canopy to a support surface and wherein the awning is extended.
Figure 12B:
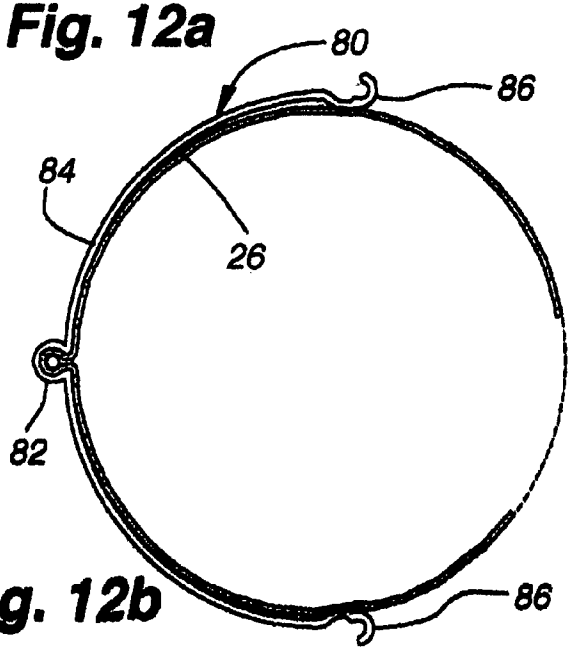
FIG. 12*b* is an end elevation similar to FIG. 12*a* with the awning fully retracted.

With reference to FIGS. 12*a* and 12*b*, a further alternative embodiment of the connection system is illustrated wherein the flexible strip 52 of fabric material is eliminated as part of the connection system and the rigid or semi-rigid cover 80 is redesigned slightly so as to have an inwardly opening but outwardly protruding C-shaped hollow bead 82 at a location intermediate its side edges such as at the midline of the cover's body 84. The longitudinal edges 86 of the body 84 are rounded so that the inner proximal edge (not seen) of the awning canopy 26 can be secured to the mounting rail 74 on the support surface 24 with the awning canopy forming a generally inverted V-shaped configuration as it passes through the cover. The canopy is anchored at a location intermediate its distal 30 and proximal 28 edges in the C-shaped hollow bead 82 at the top of the cover with an anchor rod (not seen) in the manner described previously. The awning canopy assumes the relationship with the cover illustrated in FIG. 12*a* when the awning is fully extended, but when the awning is fully retracted, as shown in FIG. 12*b*, the roll bar 32 again is tucked into the generally semicylindrically shaped body of the cover which again forms an overcenter connection with the wrapped canopy fabric to help secure the cover to the roll bar in the retracted position of the awning.

Figure 13A:
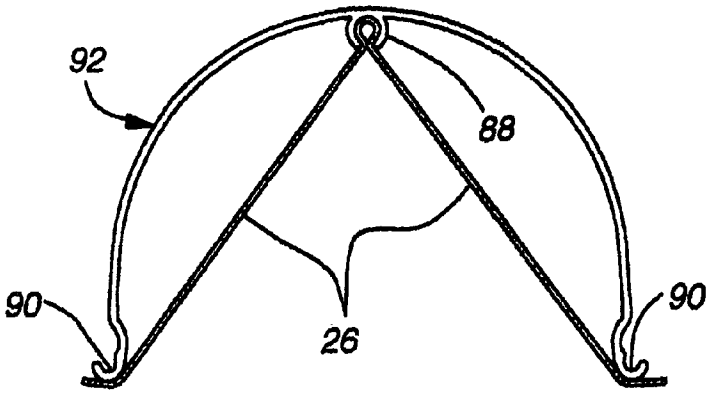
FIG. 13*a* is an end elevation similar to FIG. 12*a* showing a third alternative semicylindrical cover for interconnecting an awning canopy with a support surface and wherein the awning is fully extended.
Figure 13B:
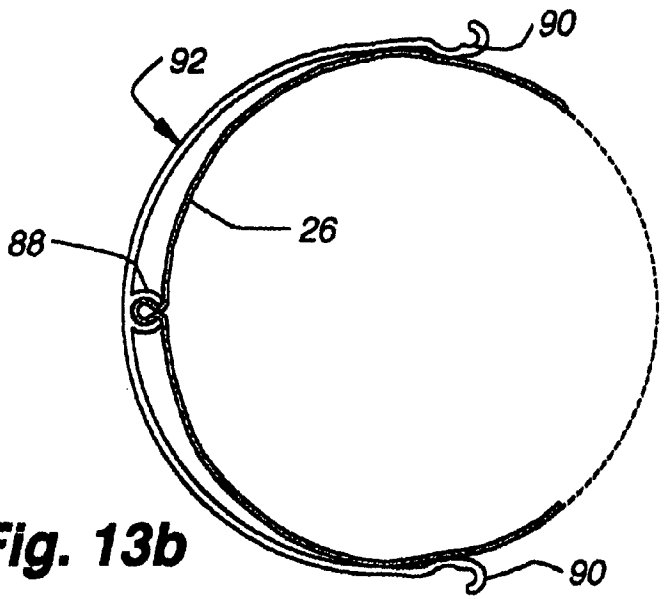
FIG. 13*b* is an end elevation similar to FIG. 13*a* showing the awning fully retracted.

FIGS. 13*a* and 13*b* disclose still another alternative embodiment very similar to that shown in FIGS. 12*a* and 12*b* except a hollow C-shaped bead 88 is formed at a location intermediate the curved side edges 90 of the cover 92 such as along the midline of the cover so as to protrude inwardly and of course open inwardly as well. The awning canopy 26 is secured to the inwardly protruding bead 88 at an intermediate location between its distal 30 and proximal 28 edges identically to that in FIGS. 12*a* and 12*b* so that the awning canopy assumes the position of FIG. 13*a* when the awning is fully extended and the position of FIG. 13*b* when the awning is fully retracted with the roll bar 32 tucked within the cover 92. Again, the cover is slightly greater than semicylindrical or has a slightly greater than 180° arc so as to form an overcenter snap-like connection to the fabric covered roll bar.

In a still further embodiment shown in FIGS. 14-24, the connection system again includes a flexible strip of material 94 that is interconnected with a rigid or semi-rigid cover 96 with the cover in turn being connected to the canopy 26 of an awning wherein the canopy is wrapable about a roll bar 32 rotatably mounted on the distal end of support arms 38. In this embodiment, the flexible strip of material 94 is slightly more narrow than the strip of material 52 of the previous embodiments so that the cover is maintained in a closer relationship to the support surface 24.

The inner or proximal edge 98 of the flexible strip 94 is hemmed and connected to the mounting rail 74 identically to that previously described with the outer or distal edge 100 of the flexible strip being connected to the cover 96. The cover is of generally semicylindrical configuration and has inner 102 and outer 104 skirt-like extensions that form a generally flat or at least less arcuate extension from the substantially semicylindrical main body 106 of the cover. The outer extension 104 has a generally C-shaped or oval bead 108 opening inwardly for attachment to the inner or proximal edge of the awning canopy. The inner edge 28 of the canopy is hemmed and a retention rod 110 is inserted into the hem and positioned within the oval bead 108 for retention therein. The hem and the rod can be positively secured in the oval bead in this embodiment as well as the other embodiments described in the present application with a threaded fastener 112 in a manner to be described in more detail hereafter.

Figure 14:
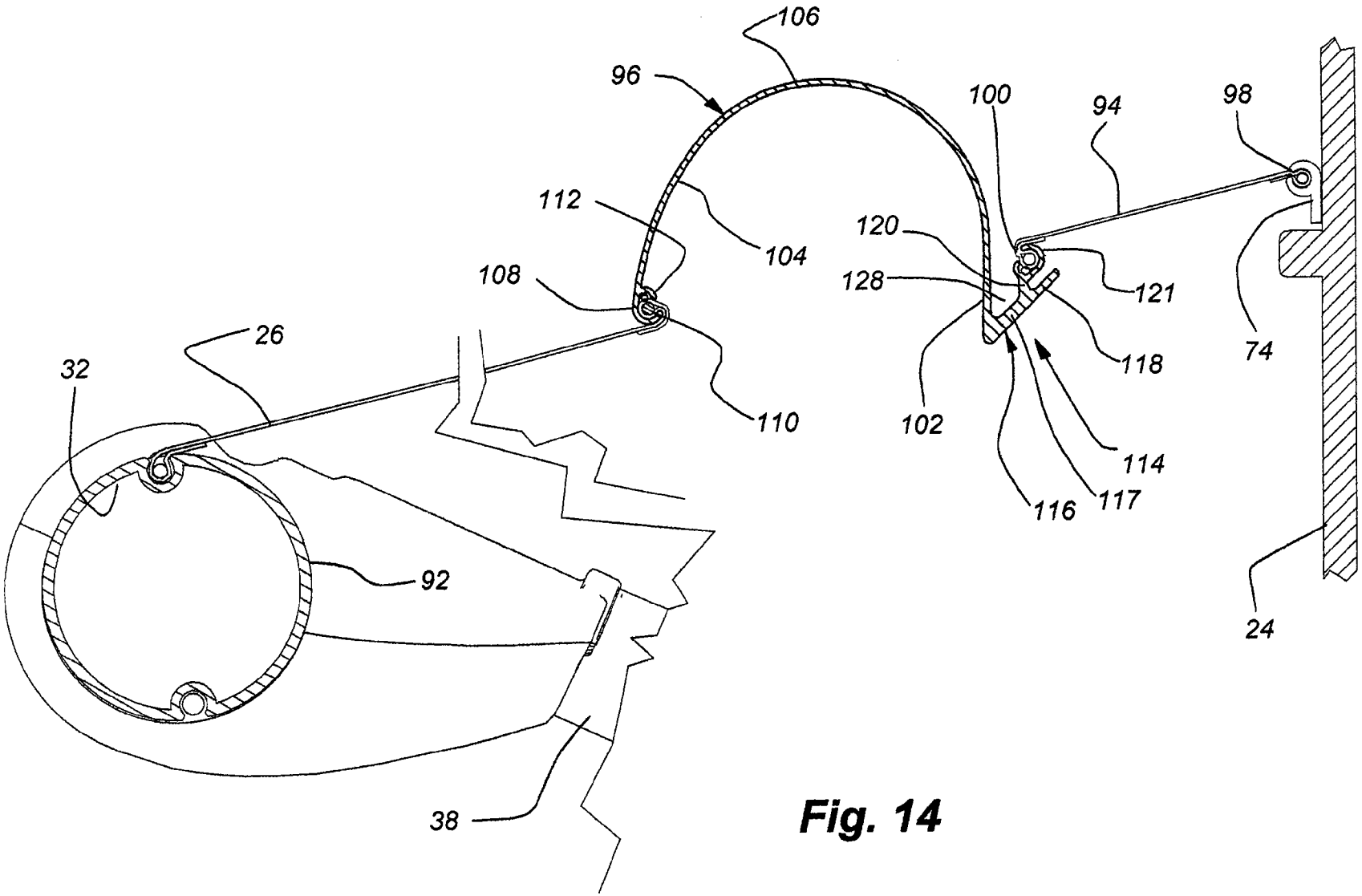
FIG. 14 is a fragmentary vertical section through still a further embodiment of the present invention with the connection system being incorporated into an awning as shown in FIG. 4 of the first-described embodiment.
Figure 15:
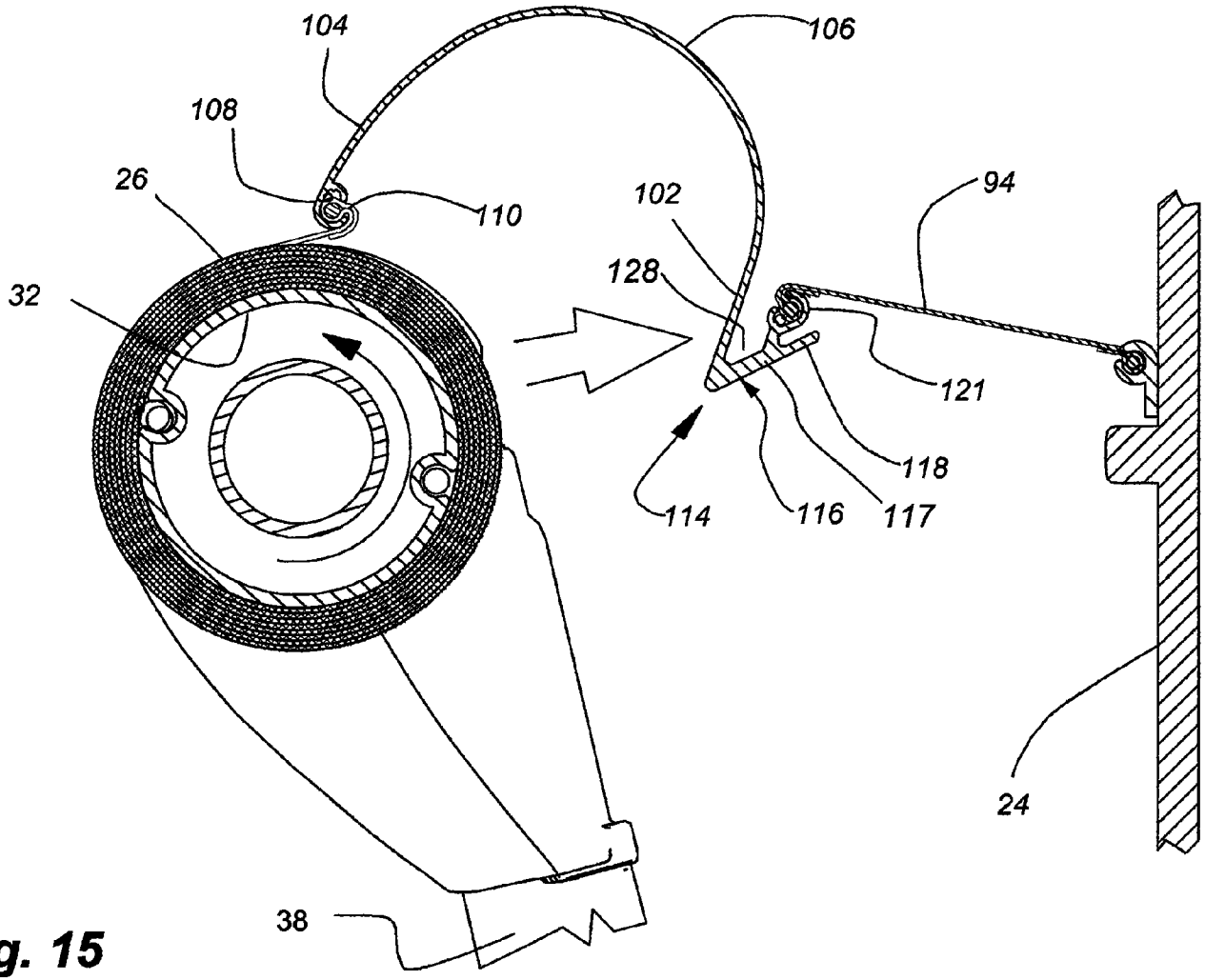
FIG. 15 is a vertical section similar to FIG. 14 with the awning having been partially retracted.
Figure 17:
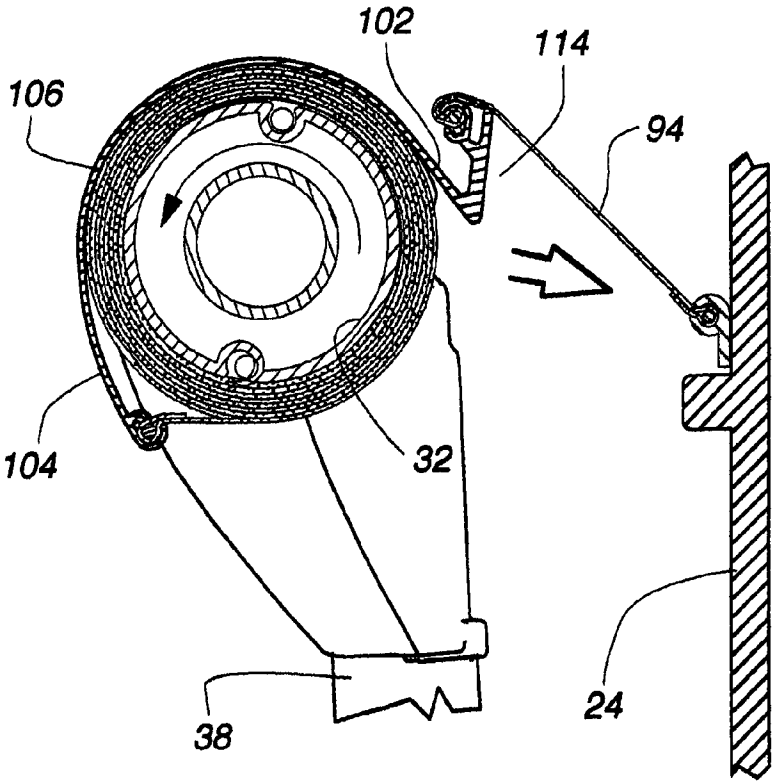
FIG. 17 is a vertical section similar to FIG. 16 with the awning further retracted.
Figure 16:
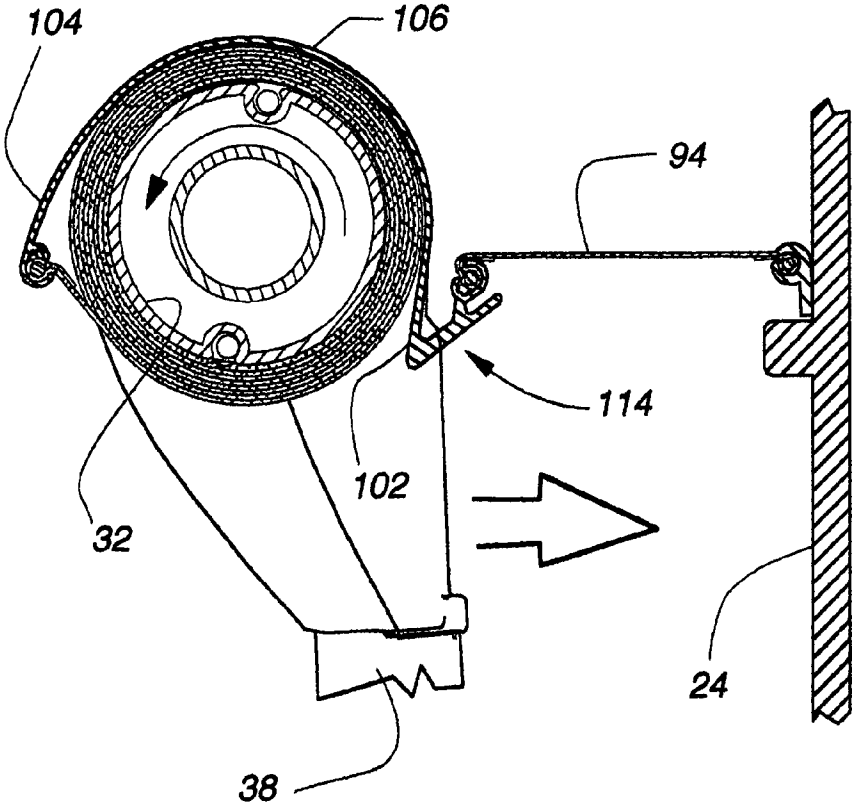
FIG. 16 is a vertical section similar to FIG. 14 with the awning having been further retracted so that the roll bar is tucked into the cover.
Figure 18:
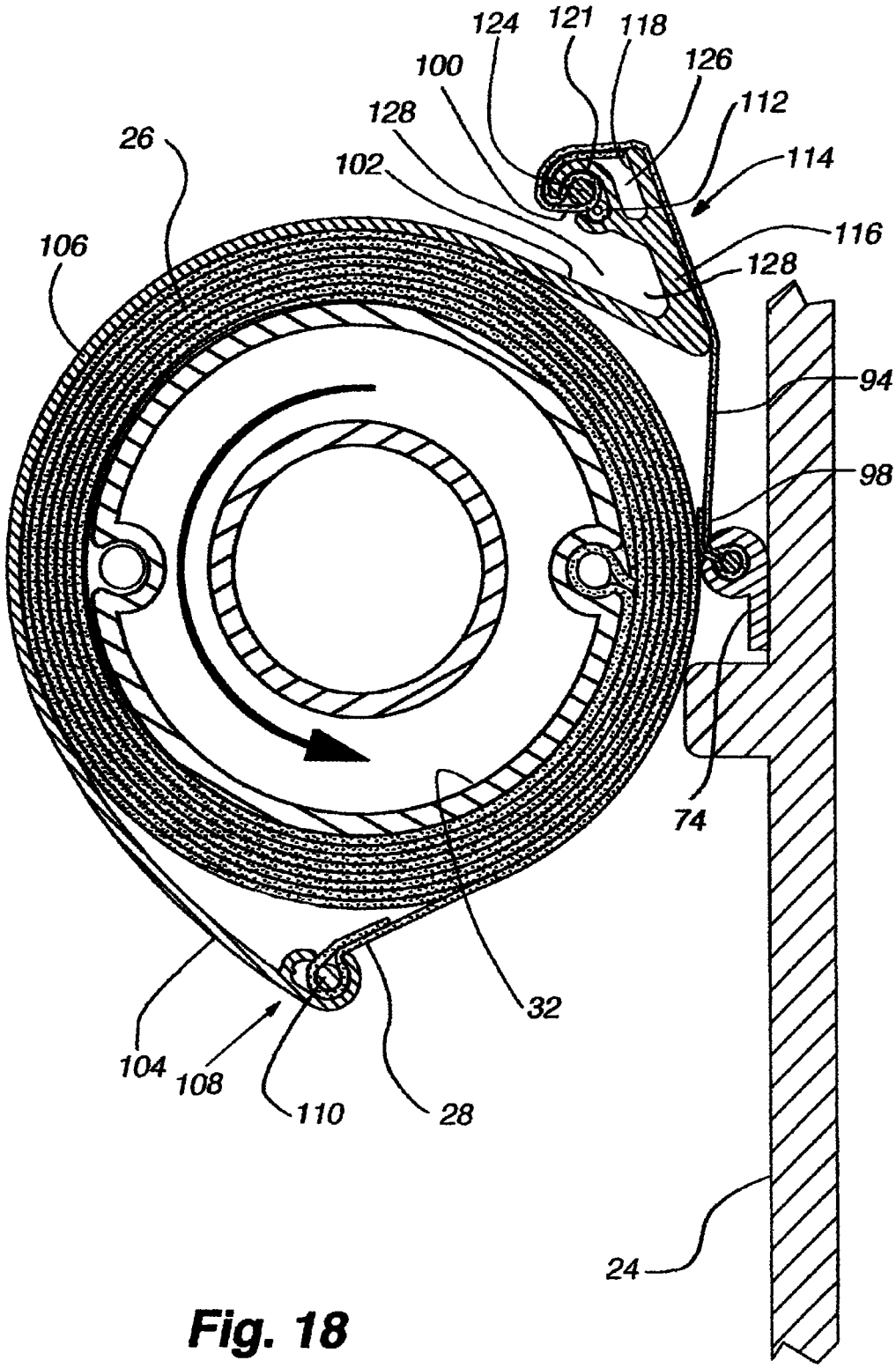
FIG. 18 is an enlarged vertical section similar to FIG. 17 with the awning in a fully retracted position.

The inner extension 102 has a generally V-shaped body 114 with one leg of the V defined by the generally flat skirt extension 102. The other leg 116 of the V extends upwardly and generally toward the support surface when the awning is fully extended as shown in FIG. 14. The leg 116 has a main body 117 and a bifurcated end defining a first finger 118 functioning as a counterweight and a second finger 120 functioning as a lever arm with the second finger including a generally C-shaped or oval bead 121 defining a pivot or fulcrum to which the outer or distal edge 100 of the flexible strip of material 94 can be secured.

Figure 20:
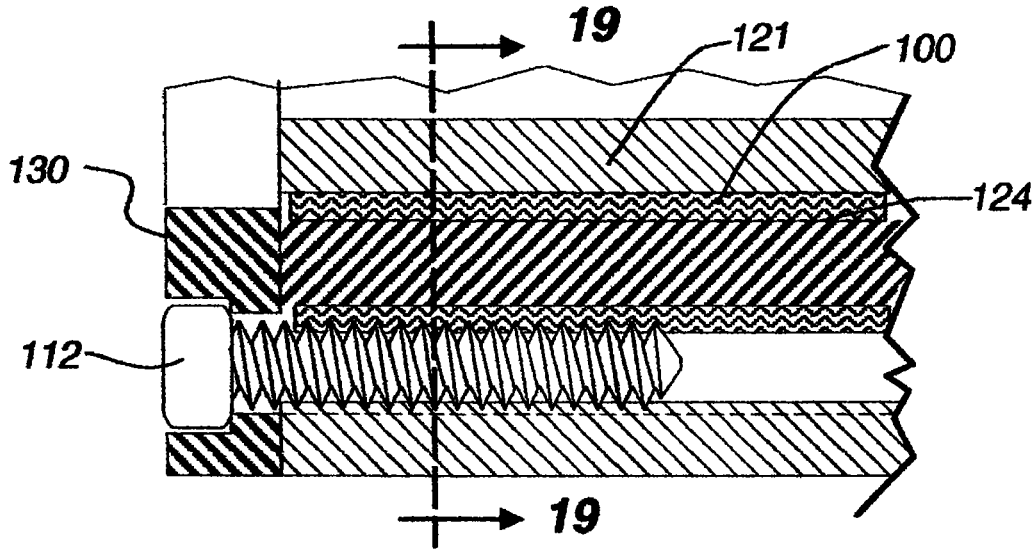
FIG. 20 is a section taken along line 20-20 of FIG. 21.
Figure 19:
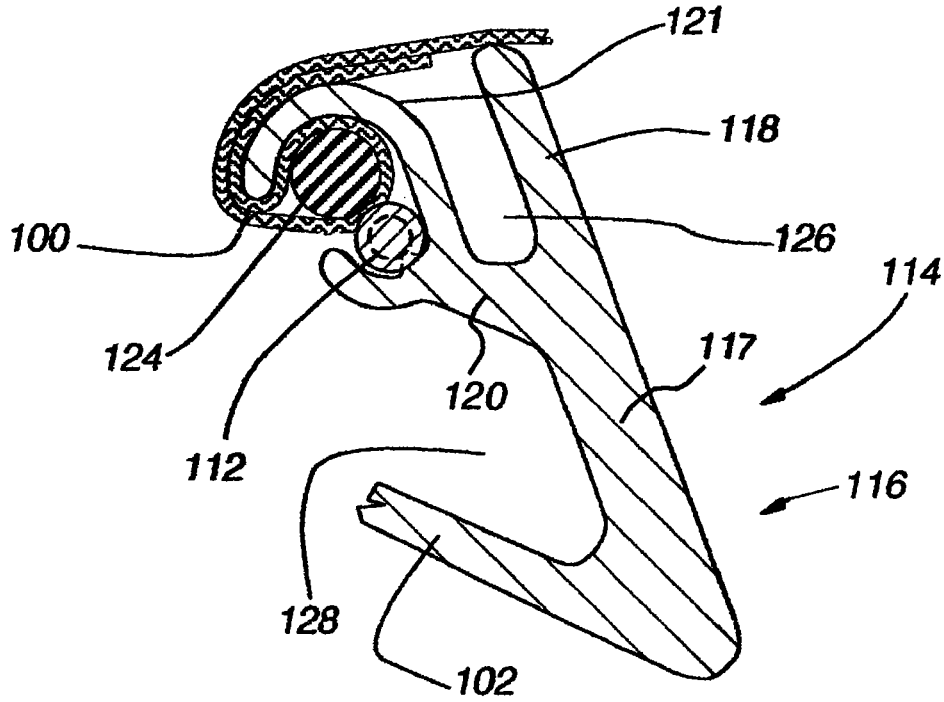
FIG. 19 is a fragmentary section taken along line 19-19 of FIG. 20.

The outer edge 100 of the flexible strip of material, as possibly best seen in FIGS. 19 and 20, is hemmed and again a retention rod 124 is inserted into the hem and the hemmed edge with the retention rod is positioned within the oval-shaped bead 121 of the second finger 120. In order to positively secure the hemmed edge of the flexible strip in the bead, a threaded fastener 112 is axially screwed into the remaining space within the oval-shaped opening so as to pinch and compress the hemmed edge of the flexible material against the inner wall of the bead. Of course, a similar system for connection is used on the opposite edge of the cover and in the other embodiments of the invention described herein.

The V-shaped body 114 defines a large trough 128, contiguous with the main body 106 of the cover, in which water running off the flexible strip 94 or the cover 96 can accumulate. Before there is much accumulation, however, water will run out of the open ends of the trough at opposite ends of the cover. Accordingly, this water is also prevented from leaking beneath the awning. Any leakage or seepage problems are avoided along the outer edge of the cover inasmuch as the hemmed inner or proximal edge 28 of the awning canopy is positioned within the bead 108 along the outer edge of the cover which is inwardly opening.

The second finger or lever arm 120 has a lower end that is coincident with the intersection of the main portion 117 of the leg 116, which extends downwardly from the intersection, and the first finger 118, which extends upwardly from the intersection. The first finger 118 therefore functions as a counterweight as mentioned previously to help pivot the cover 96 in a counterclockwise direction when the awning is being extended. In other words, the weight of the cover outwardly of the bead or pivot 121 biases the cover to pivot in a counterclockwise direction about the bead 121 of the second finger and to counter that bias, some weight obtained with the first finger 118 needs to extend in an opposite direction from the main body 117 of the leg 116. Further, it is beneficial that the weight of the first finger 118 be spaced from the bead on the end of the second finger 120 so as to establish leverage through the length of the second finger, which therefore functions as a lever arm.

Figure 22:
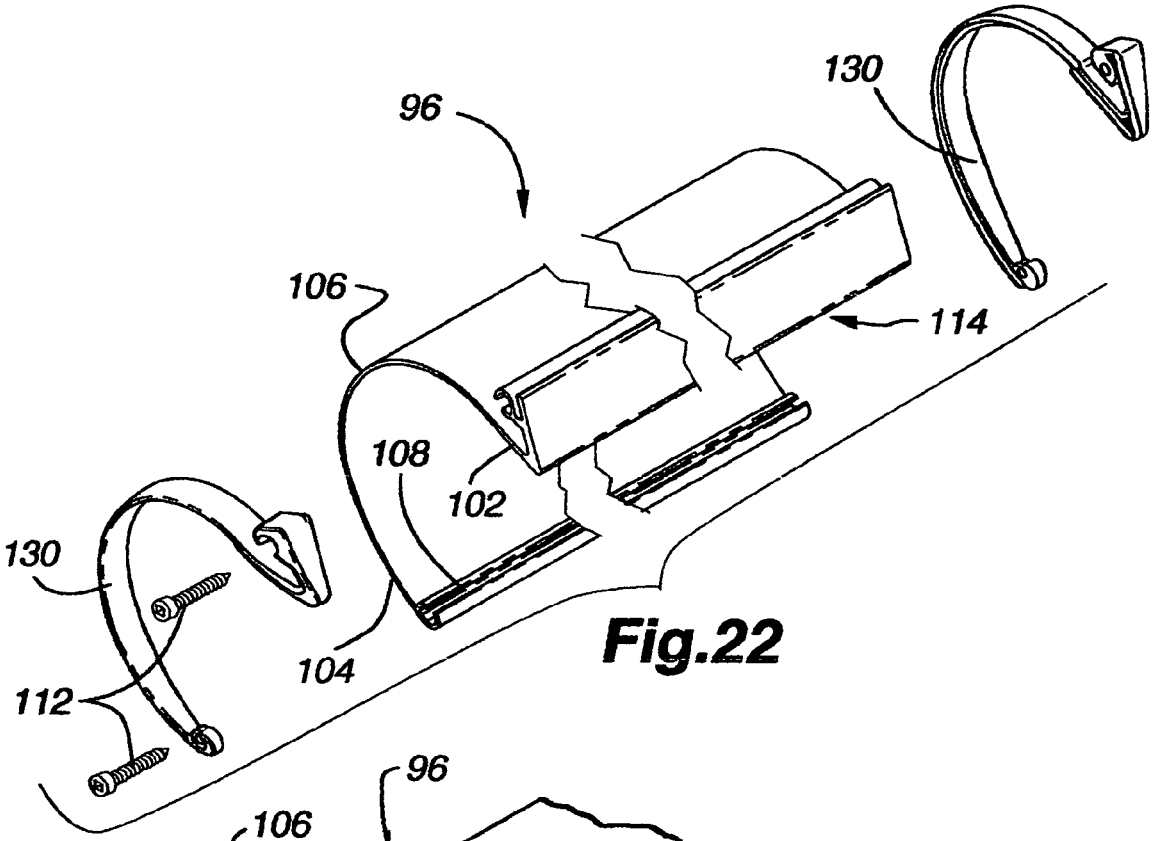
FIG. 22 is an exploded isometric of a portion of the connection system shown in FIG. 14.
Figure 21:
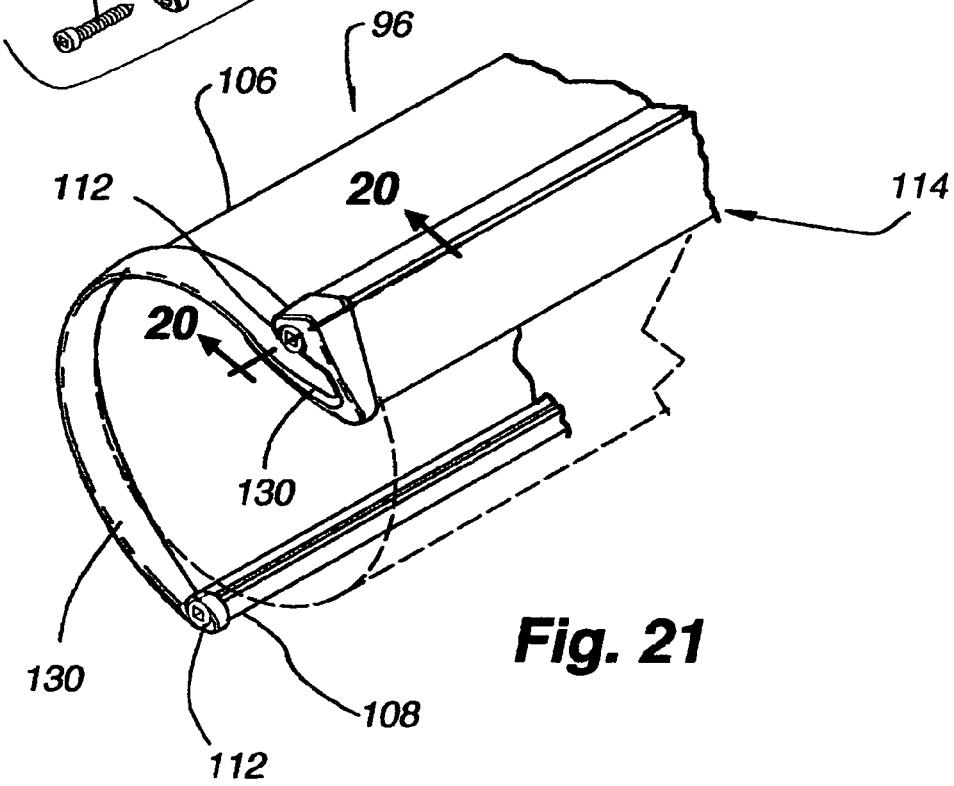
FIG. 21 is a fragmentary isometric showing one end of a portion of the connection system of the present invention with the roll bar shown in dashed lines.
Figure 23:
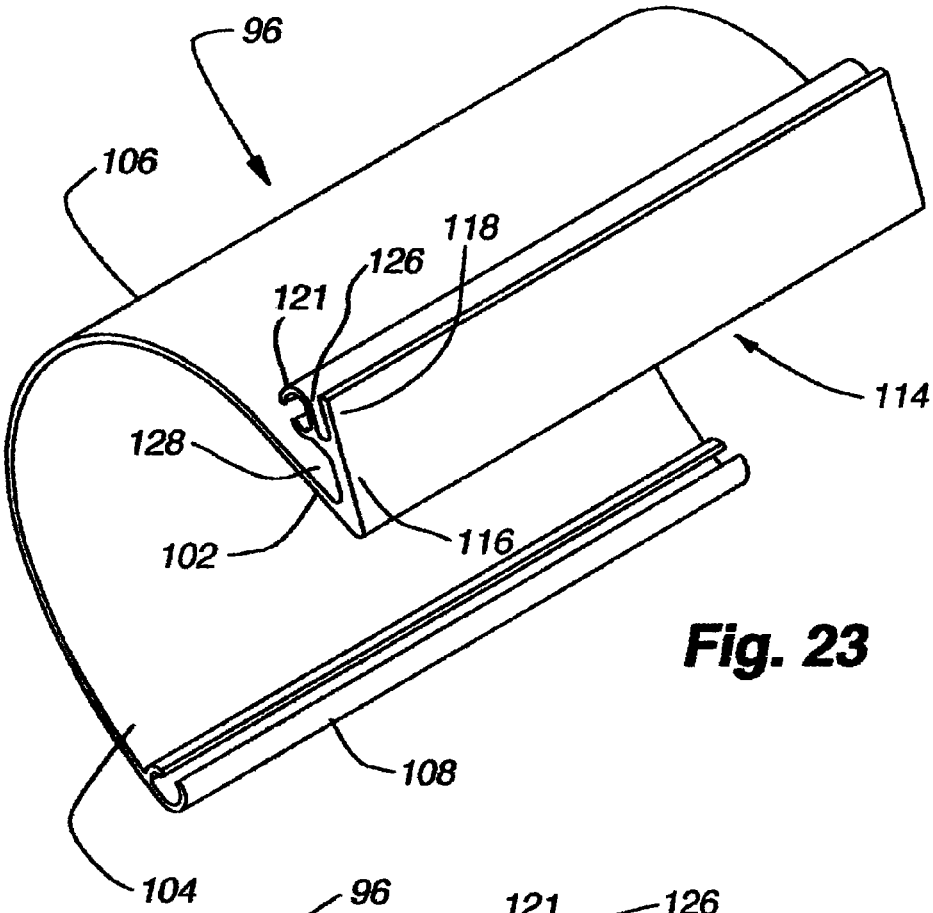
FIG. 23 is an isometric of the cover of the connection system of FIG. 14.
Figure 24:
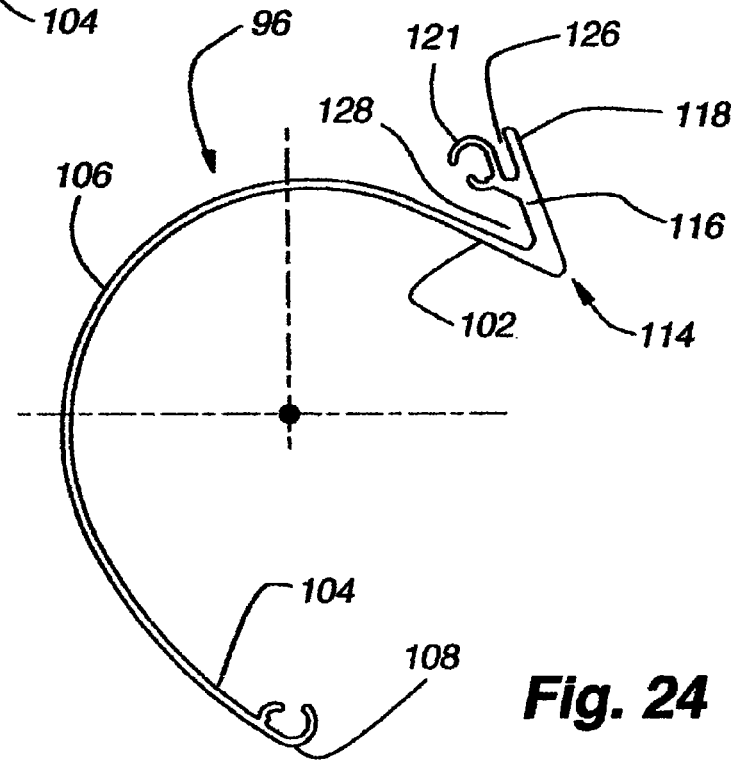
FIG. 24 is a vertical section taken through the cover of FIG. 23.

With reference to FIGS. 21 and 22, the ends of the cover are provided with aesthetically pleasing end caps 130 of the same general cross section as the cover 96 itself. The end caps are held in place with the fasteners 112 which are used to pinch or otherwise compress and retain the hemmed edges of the flexible strip and the awning canopy within the oval-shaped beads of the cover.

It should also be appreciated the V-shaped body 114 of the cover along its inner edge is larger and therefore relatively heavy in comparison to the opposite or outer edge 108 of the cover. The weighted inner edge of the cover is important to the operation of the awning in that when the awning is initially being extended from its fully retracted position of FIG. 18, the roll bar commences rotation in a clockwise direction as viewed in FIG. 18 and if the cover 96 is not otherwise encouraged to rotate with the roll bar, the awning canopy will likely unfurl through the gap between the support surface 24 and the outer edge 108 of the cover and not move to its extended position. However, if the cover is encouraged to rotate in a clockwise direction with the roll bar, it has been found the support arms 38 for the roll bar will also be encouraged to pivot away from the support surface allowing the awning to move toward its extended position. In the fully retracted position of FIG. 18, the relatively heavy V-shaped inner edge 114 is held in an elevated position due to the torque placed on the canopy by the roll bar. The torque on the canopy is transferred into the cover thereby rotating the cover in a counterclockwise direction and elevating the V-shaped edge 102. However, when the roll bar is rotated in an opposite clockwise direction to extend the awning, the relatively heavy V-shaped edge 102 is no longer held up and its relatively heavy weight in comparison to the opposite edge 108 of the cover allows the cover to rotate in a clockwise direction. This clockwise movement of the cover further opens the gap between the support surface 24 and the relatively light edge 108 of the cover and encourages the support arms 38 to pivot away from the support surface 24 thereby encouraging the awning to move toward its extended position. As mentioned previously, the counterweight of first finger 118 further facilitates this movement of the cover.

It will be appreciated from the above that a connection system has been described wherein an awning canopy can be protected from environmental elements when fully retracted and with a fairly simple system that does not leak and is not prone to malfunction. It is also aesthetically attractive as the rigid or semi-rigid cover element of the connection system can be made of any suitable finish or color to complement, for example, the support surface on which it is mounted.

Although the present invention has been described with a certain degree of particularity, it is understood the present disclosure has been made by way of example, and changes in detail or structure may be made without departing from the spirit of the invention as defined in the appended claims.

What is claimed is:

1. A retractable awning for mounting on a support surface and movable between extended and retracted positions, said awning comprising in combination: a roll bar; an awning canopy having distal and proximal edges parallel to said support surface, said distal edge being secured to said roll bar about which said canopy can be wrapped in the retracted position of the awning, a retractable support structure adapted to be operatively connected at one end to said support surface and at an opposite end to said roll bar for moving said canopy between said extended and retracted positions, and a flexible connection system adapted to operatively interconnect said proximal edge of said canopy to said support surface, said connection system including a flexible strip of material having parallel distal and proximal edges and a semi-rigid elongated one-piece cover of generally semicylindrical cross-sectional configuration having an arcuate curvature slightly greater than 180° and first and second opposed longitudinal edges, said first edge of said cover being secured to said proximal edge of said canopy and said second edge of said cover being secured to said distal edge of said flexible strip, said proximal edge of said flexible strip being adapted to be secured to said support surface, whereby when said awning is moved from said extended to said retracted position, said canopy wraps around said roller and said roller is tucked into and gripped by said semicylindrical cover.

2. The awning of claim 1 further including motor means for reversibly rotating said roller.

3. The awning of claim 1 further including spring means in said roller biasing said roller toward the retracted position of the awning.

4. The awning of claim 1 wherein said cover defines a generally semicylindrical wall having a predetermined radius of curvature and further including enlargements along said first and second edges of said cover that protrude radially inwardly of said radius of curvature.

5. The awning of claim 1 wherein said cover includes generally hollow substantially C-shaped beads along said first and second edges for connection to said proximal edge of said canopy and said distal edge of said flexible strip respectively.

6. The awning of claim 5 wherein said proximal edge of said canopy and said distal edge of said flexible strip are hemmed with the hemmed edges being received in said hollow beads respectively and further including retaining rods inserted in said hemmed edges to secure said edges to said cover.

7. The awning of claim 1 wherein said cover is made of aluminum.

8. The awning of claim 1 further including an elongated trough on said cover beneath said second edge of said cover.

9. The awning of claim 8 wherein said trough is of generally J-shaped cross section.

10. The awning of claim 8 wherein said trough is integral with the cover.

11. The awning of claim 8 wherein said trough is of generally U-shaped configuration.

12. The awning of claim 1 wherein said cover includes generally flat side skirts on which said first and second longitudinal edges are formed.

13. The awning of claim 12 wherein said first and second edges include generally C-shaped beads for connection to said proximal edge of said canopy and said distal edge of said flexible strip respectively and wherein said second edge defines a generally V-shaped body with a lever arm and a fulcrum and weighted legs extending in opposite directions from said lever arm to bias pivotal movement of said cover in a desired direction about said fulcrum.

14. The awning of claim 1 wherein said second edge of said cover is heavier than said first edge.

15. The awning of claim 13 wherein said second edge of said cover is heavier than said first edge.

* * * * *